US008361941B2

(12) United States Patent
Ramsey

(10) Patent No.: US 8,361,941 B2
(45) Date of Patent: Jan. 29, 2013

(54) ANTIWEAR ANGENT AND LUBRICATING COMPOSITIONS THEREOF

(75) Inventor: Charla A. Ramsey, Concord Township, OH (US)

(73) Assignee: The Lubrizol Corporation, Wickliffe, OH (US)

( * ) Notice: Subject to any disclaimer, the term of this patent is extended or adjusted under 35 U.S.C. 154(b) by 0 days.

(21) Appl. No.: 13/153,717

(22) Filed: Jun. 6, 2011

(65) Prior Publication Data

US 2011/0237472 A1 Sep. 29, 2011

Related U.S. Application Data

(60) Continuation of application No. 12/566,758, filed on Sep. 25, 2009, now abandoned, which is a division of application No. 11/627,405, filed on Jan. 26, 2007, now abandoned.

(51) Int. Cl.
*C10M 137/08* (2006.01)
*C10M 135/04* (2006.01)

(52) U.S. Cl. ..... 508/436; 508/435; 508/423; 508/425; 508/569

(58) Field of Classification Search ..... 508/186, 508/391, 370, 368, 425, 272, 421, 428, 429, 508/430, 435, 436, 423, 427, 569
See application file for complete search history.

(56) References Cited

U.S. PATENT DOCUMENTS

| | | | | |
|---|---|---|---|---|
| 2,411,671 | A * | 11/1946 | Smith et al. | 508/423 |
| 3,197,405 | A | 7/1965 | LeSuer | |
| 3,544,465 | A | 12/1970 | Braid | |
| 3,733,275 | A * | 5/1973 | Hagne | 508/210 |
| 5,354,484 | A * | 10/1994 | Schwind et al. | 508/192 |
| 6,528,458 | B1 * | 3/2003 | Tagliamonte et al. | 508/185 |
| 6,573,223 | B1 * | 6/2003 | Vinci | 508/192 |
| 6,617,287 | B2 * | 9/2003 | Gahagan et al. | 508/192 |
| 6,656,887 | B2 * | 12/2003 | Yagishita et al. | 508/371 |
| 6,730,640 | B2 | 5/2004 | Sowerby et al. | |
| 6,919,301 | B2 * | 7/2005 | Nakatani et al. | 508/391 |
| 2005/0107269 | A1 | 5/2005 | Yagishita et al. | |
| 2005/0130855 | A1 | 6/2005 | Yagishita | |
| 2005/0143266 | A1 | 6/2005 | Yagishita | |

FOREIGN PATENT DOCUMENTS

| | | | |
|---|---|---|---|
| EP | 1544279 | A1 | 6/2005 |
| WO | 02/102945 | A1 | 12/2002 |

OTHER PUBLICATIONS

Search Report of corresponding international Application No. PCT/US2008/051126 dated Aug. 8, 2008.

* cited by examiner

*Primary Examiner* — Pamela H Weiss
(74) *Attorney, Agent, or Firm* — David M. Shold; Christopher D. Hilker

(57) ABSTRACT

The present invention relates to an antiwear agent and lubricating compositions thereof. The invention further provides for a method of lubricating a driveline device or a grease application by employing a lubricating composition containing the antiwear agent.

19 Claims, No Drawings

ANTIWEAR ANGENT AND LUBRICATING COMPOSITIONS THEREOF

This is a continuation of copending application U.S. Ser. No. 12/566,758 filed on Sep. 25, 2009, now abandoned, which is a divisional of application U.S. Ser. No. 11/627,405, filed on Jan. 26, 2007 now abandoned.

FIELD OF INVENTION

The present invention relates to an antiwear agent and lubricating compositions thereof. The invention further provides for a method of lubricating a driveline device or a grease application by employing a lubricating composition containing the antiwear agent.

BACKGROUND OF THE INVENTION

One of the important parameters influencing durability or wear resistance of devices employing a lubricating composition is the effectiveness of phosphorus antiwear or extreme pressure additives at providing devices with appropriate protection under various conditions of load and speed. However, many of the phosphorus antiwear or extreme pressure additives contain sulphur. Due to increasing environmental concerns, the presence of sulphur in antiwear or extreme pressure additives is becoming less desirable. In, addition, many of the sulphur-containing antiwear or extreme pressure additives evolve volatile sulphur species, resulting in lubricating compositions containing antiwear or extreme pressure additives having an odour, which may also be detrimental to the environment or evolve emissions that may be higher than increasingly tighter health and safety legislation specifies.

In addition, many of the antiwear or extreme pressure additives employed have at least one of (i) limited extreme pressure and antiwear performance over a wide range of operating conditions, (ii) limited oxidative stability, (iii) form deposits, or (iv) cause corrosion (for example copper corrosion).

Driveline power transmitting devices (such as gears or transmissions, especially axle fluids and manual transmission fluids (MTFs)), and grease applications, present highly challenging technological problems and solutions for satisfying the multiple and often conflicting lubricating requirements, whilst providing durability and cleanliness.

U.S. Pat. No. 3,197,405 discloses lubricating oils containing amine salts of phosphorylated hydroxy-substituted triesters of phosphorothioic acids. The amine salts of the phosphorylated hydroxy-substituted triesters of phosphorothioic acids are useful in lubricating compositions to provide antiwear performance in gear oils, internal combustion engines and automotive transmissions.

U.S. Pat. Nos. 6,730,640; 6,872,693; 6,656,887; and US Patent Applications 2005/0143266; 2005/0130855; 2005/0107269; all disclose at least one of (i) divalent metal salt of a thiophosphoric acid esters, (ii) divalent metal salt of a phosphoric acid ester, or (iii) mixtures thereof of (i) and (ii).

Consequently, it would be desirable to provide an antiwear agent and balanced lubricant composition to meet the needs of driveline power transmitting devices or grease applications without the disadvantages of known lubricating compositions. The present invention provides such an antiwear agent and lubricating compositions thereof.

SUMMARY OF THE INVENTION

In one embodiment the invention provides a lubricating composition comprising: an oil of lubricating viscosity; and a sulphur-free amine salt of either (i) a hydroxy-substituted di-ester of phosphoric acid, or (ii) a phosphorylated hydroxy-substituted di- or tri-ester of phosphoric acid.

In one embodiment the invention provides a lubricating composition comprising: an oil of lubricating viscosity; and a sulphur-free amine salt of a hydroxy-substituted di-ester of phosphoric acid.

In one embodiment the invention provides a lubricating composition comprising: an oil of lubricating viscosity; and a sulphur-free amine salt of a phosphorylated hydroxy-substituted di- or tri-ester of phosphoric acid.

In one embodiment the invention provides a lubricating composition comprising: an oil of lubricating viscosity; and a sulphur-free amine salt of a phosphorus compound obtained/obtainable by a process comprising: reacting an amine with either (i) a hydroxy-substituted di-ester of phosphoric acid, or (ii) a phosphorylated hydroxy-substituted di- or tri-ester of phosphoric acid.

In one embodiment the invention provides a lubricating composition comprising: an oil of lubricating viscosity and an amine or metal salt of a phosphorus compound represented by Formula (1):

Formula (1)

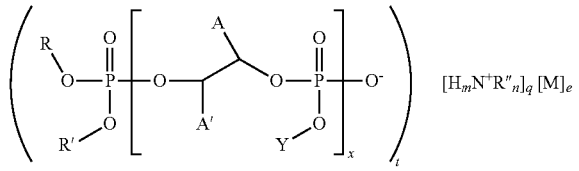

$[H_mN^+R''_n]_q\,[M]_e$ wherein

A and A' are independently H, or a hydrocarbyl group containing about 1 to about 30 carbon atoms;

each R and R" group are independently a hydrocarbyl group;

each R' is independently R, H, or a hydroxyalkyl group;

Y is independently R', or a group represented by RO(R'O)P(O)—CH(A')CH(A)- (such as RO(R'O)P(O)—$CH^2$CH($CH_3$)—);

x ranges from about 0 to about 1, with the proviso that when x=0, R' is a hydroxyalkyl group; and m and n are both positive non-zero integers, with the proviso that the sum of (m+n) is equal to about 4;

M is a metal ion;

t is an integer varying from about 1 to about 4 (or about 1 to about 2); and q and e are fractions, whose total provides complete valence to satisfy t, with the proviso that q is in the range of about 0.1 to about 1.5 (or about 0.1 to about 1), and e is in the range of about 0 to about 0.9.

In one embodiment the invention provides a lubricating composition comprising: an oil of lubricating viscosity and an amine salt of a phosphorus compound represented by Formula (1a):

Formula (1a)

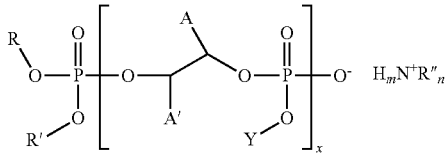

$H_mN^+R''_n$ wherein.

A and A' are independently H, or a hydrocarbyl group containing about 1 to about 30 carbon atoms;

each R and R" group are independently a hydrocarbyl group;

each R' is independently R, H, or a hydroxyalkyl group;

Y is independently R', or a group represented by RO(R'O)P(O)—CH(A')CH(A)- (such as RO(R'O)P(O)—$CH^2$CH($CH_3$)—);

x ranges from about 0 to about 1, with the proviso that when x=0, R' is a hydroxyalkyl group; and m and n are both positive non-zero integers, with the proviso that the sum of (m+n) is equal to about 4.

In one embodiment the invention provides a lubricating composition comprising: an oil of lubricating viscosity; and a sulphur-free amine salt of a phosphorus compound obtained/obtainable by a process comprising:

(a) reacting: (i) a hydroxy-substituted di-ester of phosphoric acid; and (ii) an oxygen-containing inorganic phosphorus compound to form an acidic phosphorus compound; and (b) reacting the acidic phosphorus compound with an amine.

In one embodiment the invention provides a lubricating composition comprising: an oil of lubricating viscosity; and a sulphur-free amine salt of a phosphorus compound obtained/obtainable by a process comprising: reacting an amine with either (i) a hydroxy-substituted di-ester of phosphoric acid, or (ii) a phosphorylated hydroxy-substituted di- or tri-ester of phosphoric acid.

In one embodiment the invention provides a method of lubricating a driveline device comprising supplying to the driveline device a lubricating composition disclosed herein.

In one embodiment the invention provides a method of lubricating a driveline device comprising supplying to the driveline device a lubricating composition comprising an oil of lubricating viscosity and a sulphur-free amine salt of either (i) a hydroxy-substituted di-ester of phosphoric acid, or (ii) a phosphorylated hydroxy-substituted di- or tri-ester of phosphoric acid.

In one embodiment the invention provides a method of lubricating a driveline device, comprising supplying to the driveline device a lubricating composition comprising an oil of lubricating viscosity and at least one member of the group selected from (a), (b) and (c), wherein (a), (b) and (c) are defined as follows:

(a) an amine salt of a phosphorus compound represented by Formula (1a):

Formula (1a)

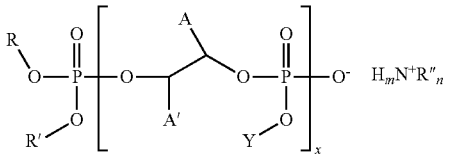

wherein

A and A' are independently H, or a hydrocarbyl group containing about 1 to about 30 carbon atoms;

each R and R" group are independently a hydrocarbyl group;

each R' is independently R, H, or a hydroxyalkyl group;

Y is independently R', or a group represented by RO(R'O)P(O)—CH(A)CH(A)- (such as RO(R'O)P(O)—$CH^2$CH($CH_3$)—);

x ranges from about 0 to about 1, with the proviso that when x=0, R' is a hydroxyalkyl group; and m and n are both positive non-zero integers, with the proviso that the sum of (m+n) is equal to about 4;

(b) a sulphur-free amine salt of a phosphorus compound obtained/obtainable by a process comprising: reacting an amine with, either (i) a hydroxy-substituted di-ester of phosphoric acid, or (ii) a phosphorylated hydroxy-substituted di- or tri-ester of phosphoric acid; and (c) a sulphur-free amine salt of a hydroxy-substituted di-ester of phosphoric acid.

In one embodiment the invention provides a new class of compounds represented by Formula (1) and Formula (1a).

In one embodiment the lubricating compositions described herein further comprises a grease thickener.

In one embodiment the invention provides an antiwear agent comprising at least one compound selected from the group consisting of (a) sulphur-free amine salt of a phosphorus compound, (b) the compound of Formula (1a), and (c) either (i) a hydroxy-substituted di-ester of phosphoric acid, or (ii) a phosphorylated hydroxy-substituted di- or tri-ester of phosphoric acid; as an antiwear agent suitable for a lubricating composition.

In one embodiment the invention provides an antiwear agent comprising either (i) a hydroxy-substituted di-ester of phosphoric acid, or (ii) a phosphorylated hydroxy-substituted di- or tri-ester of phosphoric acid; as an antiwear agent suitable for a lubricating composition.

DETAILED DESCRIPTION OF THE INVENTION

The present invention provides a lubricating composition; and a method for lubricating a driveline device as disclosed above.

Compound of Formula (1) or Formula (1a)

In one embodiment the compound represented by Formula (1) or Formula (1a) has x equal to about 1.

In one embodiment the compound represented by Formula (1) Or Formula (1a) has x is equal to about 0.

In one embodiment the compound represented by Formula (1) or Formula (1a) has m equal to about 2; and n equal to about 2.

In one embodiment the compound represented by Formula (1) or Formula (1a) has m equal to about 3; and n equal to about 1.

In one embodiment A and A' independently contain about 1 to about 10, or about 2 to about 6, or about 2 to about 4 carbon atoms.

In one embodiment R, R' and R" all independently contain about 1 to about 30, or about 1 to about 20, or about 4' to about 20 carbon atoms.

In one embodiment. R" contains about 8 to about 26, or about 10 to about 20, or about 13 to about 19 carbon atoms.

The compound of Formula (1) or Formula (1a) includes amine salts of a primary amine, a secondary amine, a tertiary amine, of mixtures thereof. In one embodiment the primary amine includes a tertiary-aliphatic primary amine.

Examples of suitable primary amines include ethylamine, propylamine, butyl amine, 2-ethylhexylamine, bis-2-ethylhexylamine, octyl amine, and dodecylamine, as well as such fatty amines as n-octylamine, n-decylamine, n-dodecylamine, n-tetradecylamine, n-hexadecylamine, n-octadecylamine and oleyamine. Other useful fatty amines include commercially available fatty amines such as "Armeen®" amines (products available from Akzo Chemicals, Chicago, Ill.), such as Armeen C, Armeen O, Armeen OL, Armeen T, Armeen HT, Armeen S and Armeen SD, wherein the letter designation relates to the fatty group, such as coco, oleyl, tallow, or stearyl groups.

Examples of suitable secondary amines include dimethylamine, diethylamine, dipropylamine, dibutylamine, diamylamine, dihexylamine, diheptylamine, methylethylamine, ethylbutylamine, N-methyl-1-amino-cyclohexane, Armeen® 2C and ethylamylamine. The secondary amines may be cyclic amines such as piperidine, piperazine and morpholine.

Examples of tertiary amines include tri-n-butylamine, tri-n-octylamine, tri-decylamine, tri-laurylamine, tri-hexadecylamine, and dimethyloleylamine (Armeen® DMOD).

In one embodiment the amines are in the form of a mixture. Examples of suitable mixtures of amines include (i) an amine with about 11 to about 14 carbon atoms on tertiary alkyl primary groups, (ii) an amine with about 14 to about 18 carbon atoms on tertiary alkyl primary groups, or (iii) an amine with about 18 to about 22 carbon atoms on, tertiary alkyl primary groups. Other examples of tertiary alkyl primary amines include tert-butylamine, tert-hexylamine, tert-octylamine (such as 1,1-dimethylhexylamine), tert-decylamine (such as 1,1-dimethyloctylamine), tertdodecylamine, tert-tetradecylamine, tert-hexadecylamine, tert-octadecylamine, tert-tetracosanylamine, and tert-octacosanylamine.

In one embodiment a useful mixture of amines is "Primene® 81R" or "Primene® JMT." Primene® 81R and Primene® JMT (both produced and sold by Rohm & Haas) are mixtures of C11 to C14 tertiary alkyl primary amines and C18 to C22 tertiary alkyl primary amines respectively.

In one embodiment the metal ion of Formula (1) is a mono- or di-valent metal, or mixtures thereof. In one embodiment the metal ion is divalent.

In one embodiment the metal of the metal ion includes, lithium, sodium, potassium, calcium, magnesium, barium, copper, nickel, tin or zinc.

In one embodiment the metal of the metal ion includes lithium, sodium, calcium, magnesium, or zinc. In one embodiment the metal of the metal ion is zinc.

In one embodiment t is equal to about 1, when the compound of Formula (1) is an amine salt or a metal salt of a monovalent metal.

In one embodiment t is equal to about 2, when the compound of Formula (1) is a metal salt of a divalent metal.

In one embodiment q is in the range of about 0.5 to 1; and e is in the range of about 0 to about 0.5.

In one embodiment the compound of Formula (1) is free of a metal ion (e is equal to zero; and q is equal to one).

In one embodiment t is equal to about 1, e is equal to about 0, and q is equal to about 1.

Processes to Prepare Compound of Formula (1) and Formula (1a)

In one embodiment the sulphur-free amine salt of a phosphorus compound obtained/obtainable by a process comprising: reacting an amine with either (i) a hydroxy-substituted di-ester of phosphoric acid, or (ii) a phosphorylated hydroxy-substituted di- or tri-ester of phosphoric acid.

In one embodiment the salt of a hydroxy-substituted di-ester of phosphoric acid may be prepared by a process comprising:

(i) reacting a phosphating agent (such as $P_2O_5$, $P_4O_{10}$, or equivalents thereof) with an alcohol, to form a mono- and/or di-phosphate ester;

(ii) reacting the phosphate ester with an alkylene oxide, to form a hydroxy substituted di-ester of phosphoric acid; and (iii) salting the hydroxy-substituted di-ester of phosphoric acid is reacted with an amine and/or metal.

In one embodiment the hydroxy-substituted di-ester of phosphoric acid of (ii) is further reacted at least once more, by repeating step (i) above, with a phosphating agent (typically forming a phosphorylated hydroxy-substituted di- or tri-ester of phosphoric acid), before salting with an amine and/or metal (as in step (iii) above).

In different embodiments, steps (i) and (ii) are repeated at least once more, optionally followed by step (i) before salting with an, amine and/or metal (as in step (iii) above). For example the salts may be prepared by a process comprising performing the steps (i), (ii), and (iii); or (i), (ii), (i), and (iii); or (i), (ii), (i), (ii), and (iii); (i), (ii), (i), (ii), (i), and (iii), or (i), (ii), (i), (ii), (i), (ii), and (iii), or (i), (ii), (i), (ii), (i), (ii), (i) and (iii), or (i), (ii), (i), (ii), (i), (ii), (i), (ii) and (iii), as defined above.

In different embodiments the reaction product yields about 1 wt % to about 99 wt %, or about 20 wt % to about 80 wt %, or about 35 wt % to about 75 wt %, of the sulphur-free amine salt of a phosphorus compound of the invention.

In different embodiments, the mole ratio in step (i) of the mono-phosphate to di-phosphate includes ranges of about 1:10 to about 10:1, or about 1:5 to about 5:1, or about 1:2 to 2:1, or about 1:1.

In different embodiments, the mole ratio (based on the amount of phosphorus) in step (i) of alkylene oxide to the mono- and/or di-phosphate ester of step (i) includes ranges of about 0.6:1 to about 1.5:1, or about 0.8:1 to about 1.2:1.

In one embodiment alkylene oxide includes ethylene oxide, propylene oxide or butylene oxide; and the mole ratio of alkylene oxide to hydroxy-substituted di-ester of phosphoric acid in step (ii) includes about 1:1.

In one embodiment alkylene oxide includes $C_5$ and higher alkylene oxide; and the mole ratio of alkylene oxide to the hydroxy-substituted di-ester of phosphoric acid in step (ii) includes broader ranges because the alkylene oxides are less volatile under reaction conditions.

The process described above in steps (i) to (iii), in different embodiments is carried out at a reaction temperature in a range of about 30° C. to about 140° C., or about 40° C. to about 110° C., or about 45° C. to about 90° C.

The process may be carried out at reduced pressure, atmospheric pressure or above atmospheric pressure. In one embodiment the process may be carried out at atmospheric pressure or above atmospheric pressure.

In one embodiment the process is carried out in an inert atmosphere. Examples, of a suitable inert atmosphere include nitrogen, argon, or mixtures thereof.

In different embodiments, the alkylene oxide contains about 1 to about 10, or about 2 to about 6, or about 2 to about 4 carbon atoms. In one embodiment the alkylene oxide include ethylene oxide, propylene oxide, butylene oxide, or mixtures thereof. In one embodiment the alkylene oxide includes propylene oxide.

In different embodiments, the alcohol contains about 1 to about 30, or about 4 to about 24, or about 8 to about 18 carbon atoms.

The alcohol may be linear or branched.

The alcohol may be saturated or unsaturated.

Examples of a suitable alcohol include hexanol, heptanol, octanol, nonanol, dodecanol, dodecanol, tridecanol, tetradecanol, pentadecanol, hexadecanol, heptadecanol, octadecanol, octadecenol (oleyl alcohol), nonadecanol, eicosyl-alcohol, or mixtures thereof. Examples of a suitable alcohol include for example, 4-methyl-2-pentanol, 2-ethylhexanol, isooctanol, or mixtures thereof.

Examples of commercially available alcohols include Alcohol® 7911, Oxo Alcohol® 7900 and Oxo Alcohol®

1100 of Monsanto; Alphanol® 79 of ICI; Nafol® 1620, Alfol® 610 and Alfol® 810 of Condea (now Sasol); Epal® 610 and Epal® 810 of Ethyl Corporation; Linevol® 79, Linevol® 911 and Dobanol® 25 L of Shell AG; Lial®125 of Condea Augusta, Milan; Dehydad® and Lorol® of Henkel KGaA (now Cognis) as well as Linopol® 7-11 and Acropol® 91 of Ugine Kuhlmann.

Useful amines include amine salts of a primary amine, a secondary amine, a tertiary amine, or mixtures thereof. A more, detailed, description of useful amines is defined above.

Conventional Phosphorus Antiwear and/or Extreme Pressure Agent

In one embodiment the lubricating composition further comprises a conventional phosphorus antiwear and/or extreme pressure agent, or mixtures thereof.

In one embodiment the lubricating composition is free of a conventional phosphorus antiwear and/or extreme pressure agents.

In different embodiments, the conventional phosphorus antiwear and/or extreme pressure agent is present in a range selected from the group consisting of about 0 wt % to about 10 wt %, about 0 wt % to about 8 wt %, about 0 wt % to about 6 wt %, and about 0.05 wt % to about 4 wt %; of the lubricating composition.

The conventional phosphorus antiwear and/or extreme pressure agent includes a non-ionic phosphorus compound, an amine salt of a phosphorus compound other than those disclosed above (such as an amine salt of a mixture of monoalkyl and dialkyl phosphoric acid esters), an ammonium salt of a phosphorus compound other than those disclosed above, a metal dialkyldithiophosphate, a metal dialkylphosphate, or mixtures thereof.

In one embodiment the conventional phosphorus antiwear or extreme pressure agent is selected from the group consisting of non-ionic phosphorus compound, a metal dialkyldithiophosphate, a metal dialkylphosphate, and mixtures thereof.

In one embodiment the conventional phosphorus antiwear and/or extreme pressure agent includes a metal dialkyldithiophosphate. The alkyl groups of the dialkyldithiophosphate may be linear or branched containing about 2 to about 20 carbon atoms, provided that the total number of carbons is sufficient to make the metal dialkyldithiophosphate oil soluble. The metal of the metal dialkyldithiophosphate typically includes monovalent or divalent metals. Examples of suitable metals include sodium, potassium, copper, calcium, magnesium, barium or zinc. In one embodiment the phosphorus-containing acid, salt or ester is a zinc dialkyldithiophosphate. Examples of a suitable zinc dialkylphosphate often referred, to as ZDDP, ZDP or ZDTP) include zinc di-(2-methylpropyl)dithiophosphate, zinc di-(amyl) dithiophosphate, zinc di-(1,3-dimethylbutyl)dithiophosphate, zinc di-(heptyl) dithiophosphate, zinc di-(octyl)dithiophosphate, zinc di-(2-ethylhexyl) dithiophosphate, zinc di-(nonyl) dithiophosphate, zinc di-(decyl) dithiophosphate, zinc di-(dodecyl)dithiophosphate, zinc di-(dodecylphenyl) dithiophosphate, zinc di-(heptylphenyl)dithiophosphate, or mixtures thereof. In one embodiment the conventional phosphorus antiwear and/or extreme pressure agent includes a metal hydrocarbylphosphate or dihydrocarbyl phosphate.

The hydrocarbyl group of the metal dialkylphosphate includes a straight-chain or a branched alkyl group, a cyclic alkyl group, a straight-chain or a branched alkenyl group, an aryl group, or an arylalkyl group.

In one embodiment the hydrocarbyl group of the metal dialkylphosphate is an oil soluble alkyl group. The alkyl group typically includes about 1 to about 40, or about 4 to about 40, or about 4 to about 20, or about 6 to about 16 carbon atoms.

Examples of the straight-chain or branched alkyl groups include methyl, ethyl, propyl, butyl, pentyl, hexyl, heptyl, octyl, nonyl, decyl, undecyl, dodecyl, tridecyl, tetradecyl, pentadecyl, hexadecyl, heptadecyl and, octadecyl groups.

The cyclic alkyl group in one embodiment contains system about 5 to about 7 carbon atoms, and in another embodiment about 6 to about 11 carbon atoms.

Examples of the cyclic alkyl group include cyclopentyl, cyclohexyl, cycloheptyl group, methylcyclopentyl, dimethylcyclopentyl, methylcyclopentyl, dimethylcyclopentyl, methyl ethyl cyclopentyl, diethylcyclopentyl, methylcyclohexyl, dimethylcyclohexyl, methylethylcyclohexyl, dimethylcyclohexyl, methyl cycloheptyl, dimethylcycloheptyl, methylethylcycloheptyl, and diethylcycloheptyl groups.

In one embodiment the straight-chain or branched alkenyl group includes those having about 2 to about 30, or about 6 to about 20 carbon atoms. Examples of the alkenyl group include butenyl, pentenyl, hexenyl, heptenyl, octenyl, nonenyl, decenyl, undecenyl, dodecenyl, tridecenyl, tetradecenyl, pentadecenyl, hexadecenyl, heptadecenyl, and octadecenyl group.

In one embodiment the aryl group includes those having about 6 to about 18 carbon atoms. Examples of the aryl group include phenyl or naphthyl.

In one embodiment the aryl group is an arylalkyl group having about 7 to about 26 carbon atoms. Examples of the arylalkyl group include tolyl, xylyl, ethylphenyl, propylphenyl, butylphenyl, pentylphenyl, hexylphenyl, heptylphenyl, octylphenyl, nonylphenyl, decylphenyl, undecylphenyl, dodecylphenyl, diethylphenyl, dibutylphenyl and dioctylphenyl.

In one embodiment the metal hydrocarbylphosphate or dihydrocarbylphosphate includes a metal salt of a mono-alkyl phosphate, and in another embodiment a metal salt of a dialkyl phosphate.

In one embodiment the metal of the metal hydrocarbylphosphate or dihydrocarbylphosphate is a monovalent metal, in another embodiment the metal is divalent, and in another embodiment the metal is trivalent.

The metal of the metal hydrocarbylphosphate or dihydrocarbylphosphate includes aluminium, calcium, magnesium, strontium, chromium, iron, cobalt, nickel, zinc, tin, lead, manganese, silver, or mixtures thereof. In one embodiment the metal is zinc.

In one embodiment the non-ionic phosphorus compound includes compounds with phosphorus atoms having, an oxidation state of +3 or +5. The non-ionic phosphorus compound includes a phosphite-ester, a phosphate ester, or mixtures thereof. A more detailed description of the non-ionic phosphorus compound include column 9, line 48 to column 11, line 8 of U.S. Pat. No. 6,103,673.

In one embodiment the amine salt of a phosphorus compound other than those disclosed herein, is described in U.S. Pat. No. 3,197,405.

In one embodiment the amine salt of a phosphorus compound other than those disclosed above, may be prepared by any one of examples 1 to 25 of U.S. Pat. No. 3,197,405.

In one embodiment the amine salt of a phosphorus compound other than those disclosed above, is a reaction product prepared from a dithiophosphoric acid is reacting with an epoxide or a glycol. This reaction product is further reacted with a phosphorus acid, anhydride, or lower ester (where "lower" signifies about 1 to about 8, or about 1 to about 6, or about 1 to about 4, or 1 to about 2 carbon atoms in the alcohol-derived portion of the ester). The epoxide includes an aliphatic epoxide or a styrene oxide. Examples of useful epoxides include ethylene oxide, propylene oxide, butene oxide, octene oxide, dodecene oxide, styrene oxide and the like. In one embodiment the epoxide is propylene oxide. The glycols include aliphatic glycols having 1 to about 12, or about 2 to about 6, or about 2 to about 3 carbon atoms. The dithiophosphoric acids, glycols, epoxides, inorganic phosphorus reagents and methods of reacting the same are described in U.S. Pat. Nos. 3,197,405 and 3,544,465. The resulting acids are then salted with amines.

Conventional Preparative Example 1

An example of suitable dithiophosphoric acid based product is prepared by adding phosphorus pentoxide (about 64 grams) at about 58° C. over a period of about 45 minutes to about 514 grams of hydroxypropyl O,O-di(1,3-dimethylbutyl)phosphorodithioate (prepared by reacting di(1,3-dimethylbutyl)-phosphorodithioic acid with about 1.3 moles of propylene oxide at about 25° C.). The mixture is heated at about 75° C. for about 2.5 hours, mixed with a diatomaceous earth and filtered at about 70° C. The filtrate contains about 11.8% by weight phosphorus, about 15.2% by weight sulphur, and an acid number of 87 (bromophenol blue).

Organo-Sulphide

In one embodiment the lubricating composition further comprises an organo-sulphide, or mixtures thereof. In one embodiment the organo-sulphide comprises at least one of a polysulphide, thiadiazole compound, or mixtures thereof.

In different embodiments, the organo-sulphide is present in a range selected from the group consisting of about 0 wt % to about 10 wt %, about 0.01 wt % to about 10 wt %, about 0.1 wt % to about 8 wt %, and about 0.25 wt % to about 6 wt %; of the lubricating composition.

Thiadiazole Compound

Examples of a thiadiazole include 2,5-dimercapto-1,3,4-thiadiazole, or oligomers thereof, a hydrocarbyl-substituted 2,5-dimercapto-1,3-4-thiadiazole, a hydrocarbylthio-substituted 2,5-dimercapto-1,3-4-thiadiazole, or oligomers thereof. The oligomers of hydrocarbyl-substituted 2,5-dimercapto-1,3-4-thiadiazole typically form by forming a sulphur-sulphur bond between 2,5-dimercapto-1,3-4-thiadiazole units to form oligomers of two or more of said thiadiazole units.

Examples of a suitable thiadiazole compound include at least one of a dimercaptothiadiazole, 2,5-dimercapto-[1,3,4]-thiadiazole, 3,5-dimercapto-[1,2,4]-thiadiazole, 3,4-dimercapto-[1,2,5]-thiadiazole, or 4-5-dimercapto-[1,2,3]-thiadaizole. Typically readily available materials such as 2,5-dimercapto-1,3,4-thiadiazole or a hydrocarbyl-substituted 2,5-dimercapto-1,3-4-thiadiazole or a hydrocarbylthio-substituted 2,5-dimercapto-1,3,4-thiadiazole are commonly utilised, with 2,5-dimercapto-[1,3,4]-thiadiazole most commonly utilised due to availability. In different embodiments the number of carbon atoms on the hydrocarbyl-substituent group includes about 1 to about 30, about 2 to about 25, about 4 to about 20, about 6 to about 16, or about 8 to about 10.

In one embodiment, the thiadiazole compound is the reaction product of a phenol with an aldehyde and a dimercaptothiadiazole. The phenol includes an alkyl phenol wherein the alkyl group contains at least about 6, e.g., about 6 to 24, or about 6 (or about 7) to about 12 carbon atoms. The aldehyde includes an aldehyde containing about 1 to about 7 carbon atoms or an aldehyde synthon, such as formaldehyde. Useful thiadiazole compounds include 2-alkyldithio-5-mercapto-[1,3,4]-thiadiazoles, 2,5-bis(alkyldithio)[1,3,4]-thiadiazoles, 2-alkyl-hydroxyphenylmethylthio-5-mercapto-[1,3,4]-thiadiazoles (such as 2-[5-heptyl-2-hydroxyphenylmethylthio]-5-mercapto-[1,3,4]-thiadiazole), and mixtures thereof.

In one embodiment the thiadiazole compound includes at least one of 2,5-bis(tert-octyldithio)-1,3,4-thiadiazole, 2,5-bis(tert-nonyldithio)-1,3,4-thiadiazole, or 2,5-bis(tert-decyldithio)-1,3,4-thiadiazole.

Polysulphide

In one embodiment at least about 50 wt % of the polysulphide molecules are a mixture of tri- or tetra-sulphides. In other embodiments at least about 55 wt %, or at least about 60 wt % of the polysulphide molecules are a mixture of tri- or tetra-sulphides.

The polysulphide includes a sulphurised organic polysulphide from oils, fatty acids or ester, olefins or polyolefins.

Oils which may be sulfurized include natural or synthetic oils such as mineral oils, lard oil, carboxylate esters derived from aliphatic alcohols and fatty acids or aliphatic carboxylic acids (e.g., myristyl oleate and oleyl oleate), and synthetic unsaturated esters or glycerides.

Fatty acids include those that contain about 8 to about 30, or about 12 to about 24 carbon atoms. Examples of fatty acids include oleic, linoleic, linolenic, and tall oil. Sulphurised fatty acid esters prepared from mixed unsaturated fatty acid esters such as are obtained from animal fats and vegetable oils, including tall oil, linseed oil, soybean oil, rapeseed oil, and fish oil.

The polysulphide includes olefins derived from a wide range of alkenes. The alkenes typically have one or more double bonds. The olefins in one embodiment contain about 3 to about 30 carbon atoms. In other embodiments, olefins contain about 3 to about 16, or about 3 to about 9 carbon, atoms. In one embodiment the sulphurised olefin includes an olefin derived, from, propylene, isobutylene, pentene or mixtures thereof.

In one embodiment the polysulphide comprises a polyolefin derived from polymerising by known techniques, an olefin as described above.

In one embodiment the polysulphide includes dibutyl tetrasulphide, sulphurised methyl ester of oleic acid, sulphurised alkylphenol, sulphurised dipentene, sulphurised dicyclopentadiene, sulphurised terpene, and sulphurised Diels-Alder adducts; phosphosulphurised hydrocarbons.

Friction Modifier

In one embodiment the lubricating composition further comprises a friction modifier. In different embodiments, the friction modifier is present in a range selected from the group consisting of about 0 wt % to about 5 wt %, about 0.1 wt % to about 4 wt %, about 0.25 wt % to about 3.5 wt %, about 0.5 wt % to about 2.5 wt %, and about 1 wt % to about 2.5 wt %, or about 0.05 wt % to about 0.5 wt % of the lubricating composition.

The friction modifier includes fatty amines, borated glycerol esters, fatty acid amides, non-borated fatty epoxides, borated fatty epoxides, alkoxylated fatty amines, borated alkoxylated fatty amines, metal salts of fatty acids, fatty imidazolines, metal salts of alkyl salicylates (may also be referred to as a detergent), metal salts of sulphonates (may also be referred to as a detergent), condensation products of carboxylic acids or polyalkylene-polyamines, or amides of hydroxyalkyl compounds.

In one embodiment the friction modifier includes a fatty acid ester of glycerol. The final product may be in the form of a metal salt, an amide, an imidazoline, or mixtures thereof. The fatty acids may contain about 6 to about 24, or about 8 to about 18 carbon atoms. The fatty acids may branched or straight-chain, saturated or unsaturated. Suitable acids include 2-ethylhexanoic, decanoic, oleic, stearic, isostearic, palmitic, myristic, palmitoleic, linoleic, lauric, and linolenic acids, and the acids from the natural products tallow, palm oil, olive oil, peanut oil, corn oil, and Neat's foot oil. In one embodiment the fatty acid is oleic acid. When in the form of a metal salt, typically the metal includes zinc or calcium; and the products include overbased and non-overbased products. Examples are overbased calcium salts and basic oleic acid-zinc salt complexes which can be represented by the general formula $Zn_4Oleate_6O$. When in the form of an amide, the condensation product includes those prepared with ammonia, or with primary or secondary amines such as diethylamine and diethanolamine. When in the form of an imidazoline, the condensation product of an acid with a diamine or polyamine such as a polyethylenepolyamine. In one embodiment the friction modifier is the condensation product of a fatty acid with about C8 to about C24 atoms, and a polyalkylene polyamine, and in particular, the product of isostearic acid with tetraethylenepentamine.

In one embodiment the friction modifier includes those formed by the condensation of the hydroxyalkyl compound with an acylating agent or an amine. A more detailed description of the hydroxyalkyl compound is described in U.S. Patent Application 60/725,360 (filed on Oct. 11, 2005, inventors Bartley, Lahiri, Baker and Tipton) in paragraphs 8, and 19-21. The friction modifier disclosed in U.S. Patent Application 60/725,360 includes an amide represented by the formula $R^1R^2N—C(O)R^3$, wherein $R^1$ and $R^2$ are each independently hydrocarbyl groups of at least about 6 carbon atoms and $R^3$ is a hydroxyalkyl group of about 1 to about 6 carbon atoms or a group formed by the condensation of said hydroxyalkyl group, through a hydroxyl group thereof, with an acylating agent. Preparative Examples are disclosed in Examples 1 and 2 (paragraphs 68 and 69 of U.S. Patent Application 60/725,360). In one embodiment the amide of a hydroxylalkyl compound is prepared by reacting glycolic acid, that is, hydroxyacetic acid, $HO—CH_2—COOH$ with an amine.

In one embodiment the friction modifier includes a secondary or tertiary amine being represented by the formula $R^4R^5NR^6$, wherein $R^4$ and $R^5$ are each independently an alkyl group of at least about 6 carbon atoms and $R^6$ is hydrogen, a hydrocarbyl group, a hydroxyl-containing alkyl group, or an amine-containing alkyl group. A more detailed description of the friction modifier is described in US Patent Application 2005/037897 in paragraphs 8 and 19 to 22.

In one embodiment the friction modifier includes a reaction product of a di-cocoalkyl amine (or di-cocoamine) with glycolic acid. The friction modifier includes compounds prepared in Preparative Examples 1 and 2 of U.S. Patent Application 60/820,516.

In one embodiment the friction modifier includes those derived from the reaction product of a carboxylic acid or a reactive equivalent thereof with an aminoalcohol, wherein the friction modifier contains at least two hydrocarbyl groups, each containing at least about 6 carbon atoms. An example of such a friction modifier includes the reaction product of isostearic acid or an alkyl succinic anhydride with tris-hydroxymethylaminomethane. A more detailed description of such a friction modifier is disclosed in US Patent Application 2003/22000 (or International Publication, WO04/007652) in paragraphs 8 and 9 to 14.

In one embodiment the friction modifier includes an alkoxylated alcohol. A detailed description of suitable alkoxylated alcohols is described in paragraphs 19 and 20 of US Patent Application 2005/0101497. The alkoxylated amines are also described in U.S. Pat. No. 5,641,732 in column 7, line 15 to column 9, line 25.

In one embodiment the friction modifier includes a hydroxyl amine compound as defined in column 37, line 19, to column 39, line 38 of U.S. Pat. No. 5,534,170. Optionally the hydroxyl amine includes borated as such products are described in column 39, line 39 to column 40 line 8 of U.S. Pat. No. 5,534,170.

In one embodiment the friction modifier includes an alkoxylated amine e.g., an ethoxylated amine derived from about 1.8% Ethomeen T-12 and 0.90% Tomah PA-1 as described in Example E of U.S. Pat. No. 5,703,023, column 28, lines 30 to 46. Other suitable alkoxylated amine compounds include commercial alkoxylated fatty amines known by the trademark "ETHOMEEN" and available from Akzo Nobel. Representative examples of these ETHOMEEN™ materials is ETHOMEEN™ C/12 (bis[2-hydroxyethyl]-coco-amine); ETHOMEEN™ C/20 (polyoxyethylene[10] cocoamine); ETHOMEEN™ S/12 (bis[2-hydroxyethyl] soyamine); ETHOMEEN™ T/12 (bis[2-hydroxyethyl]-tallow-amine); ETHOMEEN™ T/15 (polyoxyethylene-[5] tallowamine); ETHOMEEN™ 0/12 (bis[2-hydroxyethyl] oleyl-amine); ETHOMEEN™ 18/12 (bis[2-hydroxyethyl] octadecylamine); and ETHOMEEN™ 18/25 (polyoxyethylene[15]octadecylamine). Fatty amines and ethoxylated fatty amines are also described in U.S. Pat. No. 4,741,848.

In one embodiment the friction modifier includes a polyol ester as described in U.S. Pat. No. 5,750,476 column 8, line 40 to column 9, line 28.

In one embodiment the friction modifier includes a low potency friction modifier as described in U.S. Pat. No. 5,840,662 in column 2, line 28 to column 3, line 26. U.S. Pat. No. 5,840,662 further discloses in column 3, line 48 to column 6, line 25 specific materials and methods of preparing the low potency friction modifier.

In one embodiment the friction modifier includes a reaction product of an isomerised alkenyl substituted succinic anhydride and a polyamine as described in U.S. Pat. No. 5,840,663 in column 2, lines 18 to 43. Specific embodiments of the friction modifier described in U.S. Pat. No. 5,840,663 are further disclosed in column 3, line 23 to column 4, line 35. Preparative examples are further disclosed in column 4, line 45 to column 5, line 37 of U.S. Pat. No. 5,840,663.

In one embodiment the friction modifier includes an alkylphosphonate mono- or di-ester sold commercially by Rhodia under the trademark Duraphos® DMODP.

In one embodiment the friction modifier includes a borated fatty epoxide or alkylene oxide, known from Canadian Patent No. 1,188,704. These oil-soluble boron-containing compositions are prepared by reacting, at a temperature of about 80° C. to about 250° C., boric acid or boron trioxide with at least one fatty epoxide or alkylene oxide. The fatty epoxide or alkylene oxide typically contains at least about 8 carbon atoms in the fatty groups of the epoxide (or the alkylene groups of the alkylene oxide).

The borated fatty epoxides include those characterised by the method for their preparation which involves the reaction of two materials. Reagent A includes boron trioxide or any of the various forms of boric acid including metaboric acid ($HBO_2$), orthoboric acid ($H_3BO_3$) and tetraboric acid ($H_2B_40_7$), or orthoboric acid. Reagent B includes at least one fatty epoxide. The molar ratio of reagent A to reagent B is generally about 1:0.25 to, about 1:4, or about 1:1 to about 1:3, or about 1:2. The borated fatty epoxides includes compounds prepared by blending the two reagents and heating them at temperature of 80° C. to 250° C., or about 100° C. to about 200° C., for a period of time sufficient for reaction to take place. If desired, the reaction may be effected in the presence of a substantially inert, normally liquid organic diluent. During the reaction, water is evolved and may be removed by distillation.

Oils of Lubricating Viscosity

The lubricating, oil composition includes natural or synthetic oils of lubricating viscosity, oil derived from hydrocracking, hydrogenation, hydrofinishing, and unrefined, refined and re-refined oils and mixtures thereof.

Natural oils include animal oils, vegetable oils, mineral oils and mixtures thereof. Synthetic oils include hydrocarbon oils, silicon-based oils, and liquid esters of phosphorus-containing acids. Synthetic oils may be produced by Fischer-Tropsch gas-to-liquid synthetic procedure as well as other gas-to-liquid oils. In one embodiment the composition of the present invention is useful when employed in a gas-to-liquid oil. Often Fischer-Tropsch hydrocarbons or waxes may be hydroisomerised.

In one embodiment the base oil comprises a polyalphaolefin including a PAO-2, PAO-4, PAO-5, PAO-6, PAO-7 or PAO-8. The polyalphaolefin in one embodiment is prepared from dodecene and in another embodiment from decene.

In one embodiment the oil of lubricating viscosity is an ester such as an adipate.

In one embodiment the oil of lubricating viscosity is at least in-part a polymer (may also be referred to as a viscosity modifier) including hydrogenated copolymers of styrene-butadiene, ethylene-propylene polymers, polyisobutenes, hydrogenated styrene-isoprene polymers, hydrogenated isoprene polymers, polymethacrylate acid esters, polyacrylate acid esters, polyalkyl styrenes, alkenyl aryl conjugated diene copolymers, polyolefins, polyalkylmethacrylates and esters of maleic anhydride-styrene copolymers. In different embodiments the polymer includes polymethacrylate acid esters, polyacrylate acid esters, polyalkylmethacrylates and esters of maleic anhydride-styrene copolymers, polyisobutenes or mixtures thereof.

In one embodiment the oil of lubricating viscosity may contain a polymer (or viscosity modifier) present in ranges of about 0 wt % to about 70 wt % of the lubricating composition. In one embodiment the oil of lubricating viscosity may contain a polymer (or viscosity modifier) present in ranges of about 5 wt % to about 65 wt % of the lubricating composition. In one embodiment the oil of lubricating viscosity may contain a polymer (or viscosity modifier) present in ranges of about 10 to about 60 wt %, or about 15 wt % to about 50 wt % of the lubricating composition. In one embodiment the lubricating composition comprises an oil of lubricating viscosity containing, mixtures of a viscosity modifier and an API Group III or IV base oil. In one embodiment the lubricating composition contains a synthetic oil, of lubricating viscosity.

Oils of lubricating viscosity may also be defined as specified in the American Petroleum Institute (API) Base Oil Interchangeability Guidelines. In one embodiment the oil of lubricating viscosity comprises an API Group I, II, III, IV, V, VI base oil, or mixtures thereof, and in another embodiment API Group II, III, IV base oil or mixtures thereof. In another embodiment the oil of lubricating viscosity is a Group III or IV base oil and in another embodiment a Group IV base oil.

The amount of the oil of lubricating viscosity present, is typically the balance remaining after subtracting from about 100 wt % the sum of the amount of the compounds of the present invention, the friction modifier, the conventional phosphorus antiwear and/or extreme pressure agent, the organo-sulphide, and the other performance additives (described below).

In one embodiment the lubricating composition is in the form of a concentrate and/or a fully formulated lubricant. If the phosphorus containing additive, the organo-sulphide, and the other performance additives are in the form of a concentrate (which may be combined with additional oil to form, in whole or in part, a finished lubricant), the ratio of the components of the lubricating composition to the oil of lubricating viscosity and/or to diluent oil include the ranges of about 1:99 to about 99:1 by weight, or about 80:20 to about 10:90 by weight.

Other Performance Additive

The composition of the invention optionally further includes at least one other performance additive. The other performance additives include metal deactivators, detergents, dispersants, viscosity modifiers, dispersant viscosity modifiers, antioxidants, corrosion inhibitors, foam inhibitors, demulsifiers, pour point depressants, seal swelling agents, and mixtures thereof.

In different embodiments, the total combined amount of the other performance additive compounds is present in a range selected from the group consisting of about 0 wt % to about 25 wt %, about 0.1 wt % to about 15 wt %, and about 0.5 wt % to about 10 wt %, of the lubricating composition. Although one or more of the other performance additives may be present, it is common for the other performance additives to be present in different amounts relative to each other.

Antioxidants include molybdenum compounds such as molybdenum dithiocarbamates, sulphurised olefins, hindered phenols, aminic compounds such as alkylated diphenylamines (typically di-nonyl diphenylamine, octyl diphenylamine, or di-octyl diphenylamine).

Detergents include neutral or overbased detergents, Newtonian or non-Newtonian, basic salts of alkali, alkaline earth or transition metals with one or more of a phenate, a sulphurised phenate, a sulphonate, a carboxylic acid, a phosphorus acid, a mono- and/or a di-thiophosphoric acid, a saligenin, an alkylsalicylate, and a salixarate.

Dispersants include N-substituted long chain alkenyl succinimides, as well as Mannich condensation products as well as post-treated versions thereof. Post-treated dispersants include those by reaction with urea, thiourea, dimercaptothiadiazoles, carbon disulphide, aldehydes, ketones, carboxylic acids, hydrocarbon-substituted succinic anhydrides, nitriles, epoxides, boron compounds, and phosphorus compounds.

In one embodiment the dispersant includes a borated polyisobutylene succinimide. Typically the number average molecular weight of the polyisobutylene ranges from about 450 to about 5000, or about 550 to about 2500.

In different embodiments, the dispersant is present in a range selected from the group consisting of about 0 wt % to about 10 wt %, about 0.01 wt % to about 10 wt %, and about 0.1 wt % to about 5 wt %, of the lubricating composition.

Viscosity modifiers include hydrogenated copolymers of styrene-butadiene, ethylene-propylene copolymers, polyisobutenes, hydrogenated styrene-isoprene polymers, hydrogenated isoprene polymers, polymethacrylate acid esters, polyacrylate acid esters, polyalkyl styrenes, alkenyl aryl conjugated diene copolymers, polyolefins, polyalkylmethacrylates and esters of maleic anhydride-styrene copolymers. Dispersant viscosity modifiers (often referred to as DVM) include functionalised polyolefins, for example, ethylene-propylene copolymers that, have been functionalized with the reaction product of maleic anhydride and an amine, a polymethacrylate functionalised with an amine, or styrene-maleic anhydride copolymers reacted with an amine; may also be used in the composition of the invention.

Corrosion inhibitors include octylamine octanoate, condensation products of dodecenyl succinic acid or anhydride and a fatty acid such as oleic acid with a polyamine, or a thiadiazole compound described above. Metal, deactivators include derivatives of benzotriazoles (typically tolyltriazole), 1,2,4-triazoles, benzimidazoles, 2-alkyldithiobenzimidazoles or 2-alkyldithiobenzothiazoles.

Foam inhibitors include copolymers of ethyl acrylate and 2-ethylhexylacrylate and optionally vinyl acetate. Demulsifiers include trialkyl phosphates, polyethylene glycols, polyethylene oxides, polypropylene oxides and (ethylene oxide-propylene oxide) polymers. Pour point depressants include esters of maleic anhydride-styrene, polymethacrylates, polyacrylates or polyacrylamides. Seal swell agents include Exxon Necton-37™ (FN 1380) and Exxon Mineral Seal Oil (FN 3200).

Grease

In one embodiment the lubricating composition described herein further comprises a grease thickener. When the lubricating composition comprises a grease thickener, the composition may be described as a grease composition.

The grease thickener includes materials derived from (i) inorganic powders such as clay, organo-clays, bentonite, fumed silica, calcite, carbon black, pigments, copper phthalocyanine or mixtures thereof, (ii) a carboxylic acid and/or ester (such as a mono- or poly-carboxylic acid and/or ester thereof), (iii) a polyurea or diurea, or (iv) mixtures thereof.

In one embodiment the grease thickener is derived from calcite. Typically a calcite thickener is derived from an overbased calcium sulphonate or an overbased calcium carboxylate. In one embodiment the grease thickener is derived from an overbased calcium sulphonate that has been mixed with a carboxylic acid or ester.

The carboxylic acid and/or ester thereof includes a mono- or poly-carboxylic acid and/or ester thereof, or a mixture of two or more thereof. The polycarboxylic acid and/or ester may be a di-carboxylic acid and/or ester thereof.

Typically grease thickener is derived from a metal salt of a carboxylic acid and/or ester. Often the metal includes an alkali metal, alkaline metal, aluminium or mixtures thereof. Examples of suitable metals include lithium, potassium, sodium, calcium, magnesium, barium, aluminium and mixtures thereof. In one embodiment the metal includes lithium, calcium, aluminium or mixtures thereof. In one embodiment the metal includes lithium. In one embodiment the metal includes calcium.

In one embodiment the carboxylic acid and/or ester includes one or more branched alicyclic or linear, saturated or unsaturated, mono- or poly-hydroxy substituted or unsubstituted carboxylic acids and/or esters. In one embodiment the carboxylic acid includes one or more acid chlorides. In one embodiment the carboxylic acid ester includes one or more esters of one or more of the carboxylic acids with one or more alcohols. The alcohols may be alcohols of 1 to about 5 carbon atoms. In different embodiments, the carboxylic acids contain about 2 to about 30, or about 4 to about 30, or about 8 to about 27, or about 12 to about 24, or about 16 to about 20 carbon atoms per molecule.

In one embodiment the carboxylic acid and/or ester thereof includes one or more monocarboxylic acids and/or esters thereof, one or more dicarboxylic acids and/or esters thereof, or a mixture of two or more thereof. In one embodiment the carboxylic acid includes an alkanoic acid. In one embodiment the carboxylic acid and/or ester thereof includes a mixture of one or more dicarboxylic, acids and/or esters thereof and/or one or more polycarboxylic acids and/or esters thereof. In one embodiment the carboxylic acid and/or ester thereof includes a mixture of one or more monocarboxylic acids and/or ester thereof, and one or more dicarboxylic and/or polycarboxylic acids and/or esters thereof.

In different embodiments, the weight ratio of dicarboxylic and/or polycarboxylic acid and/or ester thereof to monocarboxylic acid and/or ester thereof may be in a range including about 5:95 to about 40:60, or about 20:80 to about 35:65, or about 25:75 to about 35:65, or about 30:70.

In one embodiment the carboxylic acid and/or ester thereof includes one or more hydroxystearic acids and/or esters of these acids. Examples of suitable hydroxystearic acid include 9-hydroxy stearic acid, 10-hydroxy stearic acid, 12-hydroxy stearic acid, or a mixture of two or more thereof. The esters may comprise one or more methyl esters or natural esters such as methyl 9-hydroxy stearate, methyl 10-hydroxy stearate, methyl 12-hydroxy stearate, hydrogenated castor bean oil, or a mixture of two or more thereof.

In one embodiment the carboxylic acid includes capric acid, lauric acid, myristic acid, palmitic acid, arachidic acid, behenic acid and/or lignoceric acid. In one embodiment the carboxylic acid includes one or more of undecylenic acid, myristoleic acid, palmitoleic acid, oleic acid, gadoleic acid, elaidic acid, cis-eicosenoic acid, erucic acid, nervonic acid, 2,4-hexadienoic acid, linoleic acid, 12-hydroxy tetradecanoic acid, 10-hydroxy tetradecanoic acid, 12-hydroxy hexadecanoic acid, 8-hydroxy hexadecanoic acid, 12-hydroxy icosanic acid, 16-hydroxy icosanic acid 11,14-eicosadienoic acid, linolenic acid, cis-8,11,14-eicosatrienoic acid, arachidonic acid, cis-5,8,11,14,17-eicosapentenoic acid, cis-4,7,10,13,16,19-docosahexenoic acid, all-trans-retinoic acid, ricinoleic acid lauroleic acid, eleostearic acid, licanic acid, citronelic acid, nervonic acid, abietic acid, abscisic acid, or a mixture of two or more thereof. In one embodiment the carboxylic acid includes palmitoleic acid, oleic acid, linoleic acid, linolenic acid, licanic acid, eleostearic acid, or a mixture of two or more thereof.

In one embodiment the grease thickener includes 12-hydroxystearic acid, and salts thereof.

In one embodiment the carboxylic acid includes iso-octanedioic acid, octanedioic acid, nonanedioic acid (azelaic acid), decanedioic acid (sebacic acid), undecanedioic acid, dodecanedioic acid, tridecanedioic acid, tetradecanedioic acid, pentadecanoic acid, or a mixture of two or more thereof.

In one embodiment the carboxylic acid includes nonanedioic acid (azelaic acid). In one embodiment the carboxylic acid include decanedioic acid (sebacic acid). The reactive carboxylic acid functional groups may be delivered by esters such as dimethyl adipate, dimethyl nonanedioate (Azelate), dimethyl decanedioate (sebacate), diethyl adipate, diethyl nonanedioate (azelate), diethyl decanedioate (diethyl sebacate), or mixtures of two or more thereof.

In one embodiment the grease thickener includes a polyurea thickener formed by reacting diisocyanates with amines to form (i) a diurea such as the reaction product of methylene diisocynate or toluene disocyanate with a monoamine such as stearylamine or oleylamine, (ii) a polyurea such as the reaction product of methylene diisocyanate or toluene diisocyanate with ethylene diamine in a first step and a fatty amine such as stearylamine or oleylamine in a second step to give a mixture of oligomers have more than two urea linkages per molecule and some having two linkages per molecule, (iii) a polyurea complex formed by utilizing the calcium salt of a low molecular weight acid such as acetic acid or carbonic acid in combination with polyurea, to thicken grease.

The grease composition may further comprise one or more metal deactivators, antioxidants, antiwear agents, rust inhibitors, viscosity modifiers, extreme pressure agents (as described above), or a mixture of two or more thereof.

Industrial Application

The method of the invention is useful for lubricating a variety of driveline devices or grease applications. The driveline device comprises at least one of a gear, a gearbox, an axle gear, a traction drive transmission, an automatic transmission or a manual transmission. In one embodiment the driveline device is a manual transmission or a gear, a gearbox, or an axle gear.

The automatic transmission includes continuously variable transmissions (CVT), infinitely variable transmissions (IVT), Torroidal transmissions, continuously slipping torque converted clutches (CSTCC), stepped automatic transmissions or dual clutch transmissions (DCT).

In one embodiment the invention provides for the use of the lubricating composition disclosed herein in gears and transmissions to impart at least one of antiwear performance, extreme pressure performance, acceptable deposit control, acceptable oxidation stability and reduced odour.

The following examples provide illustrations of the invention. These examples are non-exhaustive and are not intended to limit the scope of the invention.

EXAMPLES

Preparative Example 1

Step A: Phosphorus pentoxide (219 g, about 1.54 mol) is added slowly over a period of about 1.5 hours to a flask containing isooctyl alcohol (about 602 g, about 4.63 mol) whilst stirring at about 60° C. to about 70° C. in a nitrogen atmosphere. The mixture is then heated to about 90° C. and held there for about 5 hours. The product is cooled. Analysis of the product indicates a phosphorus content of about 11.6 wt %.

Step B: At temperature of about 50° C., a flask containing the product of Step A (about 760 g, about 2.71 mol based on equivalent weight of 280 g/mol) stirring at (15-40° C.) mixed with a stoichiometric amount of propylene oxide (about 157.7 g, about 2.71 mol) dropwise via an addition funnel. The propylene oxide is added over a period of about 1.5 hours, to form a mixture. The mixture is then heated to 70° C. and held for about 2 hours. The product is cooled. The product of Step B has a phosphorus content of about 9.6 wt %.

Step C: The product of Step B (about 881.5 g, 2.73 mol P based on % P=9.6) is heated to 50° C. under nitrogen and phosphorus pentoxide (129 g, 0.91 mol) is added in four equal portions over about one hour. During the addition the temperature is maintained between the range of about 55° C. to about 70° C., whilst vigorously stirring to provide a product that is a homogeneous solid. The temperature is raised to about 80° C.; and held for about 3 hours, to form a product. Upon cooling the product, contains 13.7 wt %, of phosphorus.

Step D: The product of Step C (about 706.7 g, about 2.24 mol) is heated to about 45° C. in a nitrogen atmosphere in a flask. Bis-(2-ethylhexyl)amine (about 596 g, about 2.47 mol) is added dropwise via an addition funnel over a period of about 2 hours whilst controlling the temperature to be about 55° C. to about 60° C. The flask is then heated to about 75° C. and held there, for about 2 hours. Upon cooling the product of Step D is light orange and has a phosphorus content of 7.7 wt %.

Preparative Example 2

Preparative Example 2 is prepared employing a similar procedure as Step A and Step B of Preparative Example 1. However, for Step A, a stoichiometric amount of propylene oxide (209 g, 3.60 mol) is added to isooctyl phosphate acid (about 952 g, about 3.43 mol). The mixture is then heated to about 75° C. for 4 hours. The resultant product of Step A has a phosphorus content of about 9.65 wt %. For Step B, the product of Step A (about 208 g, about 0.374 mol) is heated in the flask and bis-(2-ethylhexyl)amine (about 97.5 g, about 0.404 mol) is added dropwise via an addition funnel over a period of about 40 minutes. The reaction temperature is then raised to about 75° C. and held for about 5 hours. The resultant product has a phosphorus content of about 6.6 wt %.

Preparative Example 3

Preparative Example 3 is prepared in a similar procedure as Preparative Example 1. However, step A of Preparative Example 3 reacts phosphorus pentoxide (about 189 g, about 1.33 mol), methylamyl alcohol (about 408 g, about 4 mol). The phosphorus pentoxide is added over a period of about 75 minutes and at a temperature of about 60° C. The product is then heated to about 70° C. and held for about 1.5 hours. The resultant product has a phosphorus content of about 13.7 wt %. Step B is carried out by reacting the product of Step A (171.7 g, 0.719 mol based on equivalent weight of 240 g/mol), with about 1.1 equivalents of propylene oxide (about 46.0 g, about 0.791 mol). The resultant product has a phosphorus content of about 10.96 wt %. Step C is carried out by heating the product of Step B (about 200 g, about 0.71 mol) at about 60° C. under a nitrogen atmosphere and reacting with phosphorus pentoxide (about 33 g, about 0.23 mol). The reaction exotherm reaches about 87° C. Upon cooling to about 65° C., the flask is held at this temperature for about 1.5 hours. The flask is then cooled to about 40° C. followed by the dropwise addition over a period of about 1.5 hours of bis-(2-ethylhexyl) amine (about 200 g, about 0.83 mol). The flask is then heated to about 75° C. and held for about 2 hours. The product has a phosphorus content of about 8.6 wt %, and a nitrogen content of about 2.8 wt %.

Preparative Example 4

The process to prepare Preparative Example 4 is similar to that of Preparative Example 2. However, for Step A, the flask contains methylamyl phosphate acid (about 154.4 g, about 0.647 mol) and at about 25° C., under a nitrogen atmosphere, 1,2-epoxyhexadecane (about 163.0 g, about 0.679 mol) is added dropwise via an addition funnel over a period of about 1.5 hours. The mixture is then heated to about 75° C. and held there for about 4 hours. The product has a phosphorus content of about 6.7 wt %. The product of Step A is then heated to about 60° C., under a nitrogen atmosphere and phosphorus pentoxide (about 33 g, about 0.23 mol) is added in two portions over a period of about 1.5 hours. The temperature was held at about 75° C. for about 1.5 hours. The product is then heated to about 40° C. under nitrogen and bis-(2-ethylhexyl) amine (about 144.8 g, about 0.596 mol) was added dropwise via addition funnel over 1.5 hours. The temperature is then increased to about 70° C. and held for a period of about 2 hours. The product has a phosphorus content of about 6.6 wt %, and a nitrogen content of about 2.1 wt %.

Lubricating Compositions 1-4

Lubricating compositions 1-4 are axle fluids (AXF1, AXF2, AXF3 and AXF4) are prepared by blending into base oil, the product of Preparative Examples 1 to 4 respectively in an amount sufficient to provide 500 ppm of phosphorus. The axle fluids further contain in conventional amounts: a dispersant, a, sulphurised-olefin, corrosion inhibitor, viscosity modifier and pour point depressant (200 ppm).

Comparative Lubricating Composition 1 (CLC1): is an axle fluid prepared by blending, into base oil, the product of Conventional Preparative Example 1 in an amount sufficient to provide 500 ppm of phosphorus. The axle fluids further contain in conventional amounts: a dispersant, a sulphurised-olefin, corrosion inhibitor, viscosity modifier and pour point depressant (200 ppm).

Axle Fluid Tests

The axle fluids AXF1, AXF2, AXF3, AXF4, and CLC1 are evaluated by employing ASTM Method D6121-05a (Standard Test Method for Evaluation of the Load. Carrying Capacity of Lubricants Under Conditions of Low Speed and High Torque Used for Final Hypoid Drive Axles). The results obtained indicate that the AXF1, AXF2, AXF3, AXF4, and CLC1 axle fluids perform sufficiently to act as a useful axle fluid.

The axle fluids AXF1, AXF2, AXF3, AXF4, and CLC1 are evaluated by employing the L60-1 Thermal Oxidative Stability of Gear Lubricants Test (based on ASTM Method D5704). The results obtained indicate that AXF1, AXF2, AXF3, and AXF4 axle fluids increase in viscosity over the duration of the L60-1 test by about 20% to about 44% at about 100° C. The CLC1 axle fluid increases in viscosity over the duration of the L60-1 test by about 43% at about 100° C.

The axle fluids AXF1, AXF2, AXF3, AXF4, and CLC1 are evaluated for evolution of gaseous sulphides by Gas Chromatography Headspace Analysis. The is carried out using Agilent Equipment (Tekmar® HT3. Headspace Autosampler, a Gas chromatograph equipped with a Agilent 5973N MSD detector at about 250° C. (split ratio: of about 5:1, column. Helium flow of about 1.0 ml/min) and about 30 m long DB-5MS column and 0.25 μm thickness of stationary phase). The temperature of the headspace injection port is maintained at about 200° C. and the vials are equilibrated for about 30 minutes prior to analysing the gas phase. The vial pressure is dependent on the temperature and the flow rate of the mobile phase (helium) is about 1.0 ml/min. The GC-temperature program is from a temperature of about 50° C. (2 min isothermal), raising by about 15° C./min until about 280° C. and held for 5 minutes at about 280° C. A standard is prepared from a mixture of organo-sulphur species. A and B (about 1.0 μl of this standard mixture is added to oil). The area of the standard is obtained using the extract ion mode of the Agilent. GC/MS software. A response factor is calculated using the concentration and the area of the extracted ion peaks. The area for the sample is obtained using the same extracted ions. The area of the sample is multiplied by the standard response factor and the results are reported as ppm of species A or species B in the sample. The results indicate that AXF1, AXF2, AXF3, and AXF4 axle fluids do not evolve gaseous sulphides. The CLC1 axle fluid evolves more than 30 ppm of gaseous sulphides.

Overall the axle fluid results indicate that the sulphur-free amine salt of the present invention provide acceptable antiwear performance compared with a sulphur-containing amine salt of the CLC1 axle fluid. In addition the sulphur-free amine salt of the present invention provides reduced viscosity increase, in the L60-1 test and no detectable emission of gaseous sulphides, compared to the sulphur-containing amine salt of the CLC1 axle fluid.

Lubricating Compositions 5-8

Lubricating compositions 5-8 are automatic transmission fluids (ATF1, ATF2, ATF3 and ATF4 respectively) containing about 0.49 wt % of the product of Preparative Examples 1 to 4 respectively. The automatic transmission fluids further contain in conventional amounts: a dispersant, friction modifier, polymethacrylate viscosity modifier, phosphorus antiwear agent and a pour point dispersant (200 ppm).

Comparative Lubricating Composition 2 (CLC2): is an automatic transmission fluid prepared by blending into base oil, about 0.49 wt % the product of Conventional Preparative Example 1. The automatic transmission fluids further contain in conventional amounts: a dispersant, friction modifier, polymethacrylate viscosity modifier, phosphorus antiwear agent and a pour point dispersant (200 ppm).

Automatic Transmission Tests

The automatic transmission fluids ATF1, ATF2, ATF3, ATF4 and CLC2 are evaluated using ASTM Method D130 (copper corrosion, at about 150° C. for 3 hours); and Ford. Mercon®V 4-ball wear test also referred to as ASTM D4172-94 (2004). The 4-ball wear test is carried out twice and the results presented are an average wear scar of the two tests.

The ASTM Method D130 copper ratings for results obtained for ATF1 and CLC2 fluids are 1A and 2C respectively. The 4-ball wear test data for ATF1 and CLC2 are both 0.46 mm.

Overall the results indicate that the sulphur-free amine salt of the invention provides an automatic transmission fluid with, acceptable wear performance and reduced copper corrosion compared with a similar automatic transmission fluid CLC2.

Grease Compositions

A comparative lithium-grease composition (CGC1) is prepared containing a normal amount of phosphorus antiwear agent (similar to the product of Conventional Preparative Example 1, described above).

Grease compositions 1-4 (GR1, GR2, GR3 and GR4) of the invention is prepared in a similar way to the comparative lithium-grease composition, except the phosphorus antiwear agent employed is the product of Preparative Examples 1 to 4 respectively.

Grease Composition Tests

The grease compositions GR1 to GR4, and CGC1 are evaluated for antiwear performance using ASTM Methods D2596, D2509 and D2266. The results indicate that the grease composition of the invention and the comparative grease composition have similar performance in the tests.

It is known that some of the materials described above may interact in the final formulation, so that the components of the final formulation may be different from those that are initially added. The products formed thereby, including the products formed upon employing lubricant composition of the present invention in its intended use, may not be susceptible of easy description. Nevertheless, all such modifications and reaction products are included within the scope of the present invention; the present invention encompasses lubricant composition prepared by admixing the components described above.

While the invention has been explained in relation to its preferred embodiments, it is to be understood that various modifications thereof will become apparent to those skilled in the art upon reading the specification. Therefore, it is to be understood that the invention disclosed herein is intended to cover such modifications as fall within the scope of the appended claims.

What is claimed is:

1. A lubricating composition comprising: (a) an oil of lubricating viscosity; (b) a sulphur-free amine salt of either (i) a hydroxy-substituted di-ester of phosphoric acid, or (ii) a phosphorylated hydroxy-substituted di- or tri-ester of phosphoric acid; and (c) an organo-sulphide, wherein the sulphur-free amine salt is represented by Formula (1a):

Formula (1a)

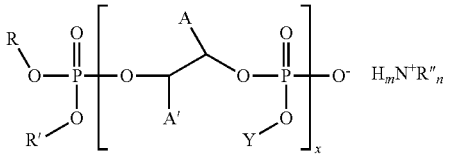

wherein

A and A' are independently H, or a hydrocarbyl group containing 1 to about 30 carbon atoms, wherein at least one of A and A' is a hydrocarbyl group;

each R and R" group are independently a hydrocarbyl group;

each R' is independently R, H, or a hydroxyalkyl group;

Y is independently R', or a group represented by RO(R'O)P(O)—CH(A')CH(A)-;

x is 1; and m and n are both positive non-zero integers, with the proviso that the sum of (m+n) is equal to 4.

2. The lubricating composition of claim 1, wherein m is equal to 3; and n is equal to 1.

3. The lubricating composition of claim 1, wherein A and A' independently contain 2 to 4 carbon atoms.

4. The lubricating composition of claim 1, wherein R, R' and R" all independently contain 4 to about 20 carbon atoms.

5. The composition of claim 1, wherein the organo-sulphide comprises at least one of a polysulphide, a thiadiazole compound, or mixtures thereof.

6. The lubricating composition of claim 1 further comprising a borated polyisobutylene succinimide.

7. The lubricating composition of claim 1 further comprising a phosphorus antiwear or extreme pressure agent, or mixtures thereof.

8. The lubricating composition of claim 1, further comprising a conventional phosphorus antiwear or extreme pressure agent selected from the group consisting of non-ionic phosphorus compound, an amine salt of a mixture of monoalkyl and dialkyl phosphoric acid esters, a metal dialkyldithiophosphate, a metal dialkylphosphate, and mixtures thereof.

9. The lubricating composition of claim 1 further comprising a friction modifier.

10. A lubricating composition comprising: an oil of lubricating viscosity; an organo-sulphide; and a sulphur-free amine salt of a phosphorus compound obtained by a process comprising either (A) or (B):

wherein (A) comprises reacting: (i) a hydroxy-substituted di-ester of phosphoric acid; and (ii) an oxygen-containing inorganic phosphorus compound to form an acidic phosphorus compound; and reacting the acidic phosphorus compound with an amine;

or wherein (B) comprises reacting a hydroxy-substituted di-ester of phosphoric acid with an amine, wherein the sulphur-free amine salt is represented by Formula (1 a):

Formula (Ia)

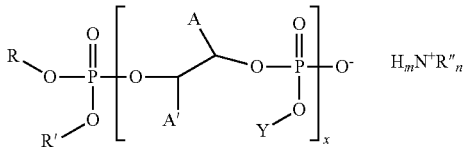

wherein

A and A' are independently H, or a hydrocarbyl group containing 1 to about 30 carbon atoms wherein at least one of A and A' is a hydrocarbyl group;

each R and R" group are independently a hydrocarbyl group;

each R' is independently R, H, or a hydroxyalkyl group;

Y is independently R', or a group represented by RO(R'O)P(O)—CH(A')CH(A)-;

x is 1; and m and n are both positive non-zero integers, with the proviso that the sum of (m+n) is equal to 4.

11. A method of lubricating a driveline device comprising supplying to the driveline device a lubricating composition comprising the lubricating composition of claim 1.

12. A lubricating composition comprising: (a) an oil of lubricating viscosity; (b) a sulphur-free amine salt of either (i) a hydroxy-substituted di-ester of phosphoric acid, or (ii) a phosphorylated hydroxy-substituted di- or tri-ester of phosphoric acid; and (c) a grease thickener, wherein the sulphur-free amine salt is represented by Formula (1a):

Formula (Ia)

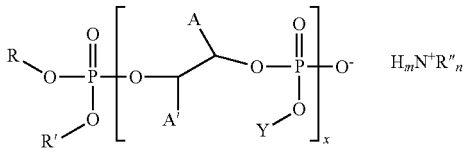

wherein

A and A' are independently H, or a hydrocarbyl group containing 1 to about 30 carbon atoms wherein at least one of A and A' is a hydrocarbyl group;

each R and R" group are independently a hydrocarbyl group;

each R' is independently R, H, or a hydroxyalkyl group;

Y is independently R', or a group represented by RO(R'O)P(O)—CH(A')CH(A)-;

x is 1; and m and n are both positive non-zero integers, with the proviso that the sum of (m+n) is equal to 4.

13. The lubricating composition of claim 12, wherein the grease thickener is derived from a carboxylic acid and/or ester.

14. The lubricating composition of claim 12, wherein the grease thickener is derived from 12-hydroxystearic acid.

15. The lubricating composition of claim 12, wherein the grease thickener is derived an overbased calcium sulphonate.

16. The lubricating composition of claim 12, wherein the grease thickener is derived from a diurea thickener, a polyurea thickener, or a polyurea complex thickener or admixtures of them.

17. The lubricating composition of claim 1, wherein the sulphur-free amine salt is derived from a primary amine, a secondary amine, a tertiary amine, or mixtures thereof, wherein the primary amine is selected from the group consisting of 2-ethylhexylamine, octylamine, dodecylamine, n-octylamine, n-decylamine, n- dodecylamine, n-tetradecylamine, n-hexadecylamine, n-octadecylamine, oleyamine, cocoamine, tallowamine, and stearylamine, wherein the secondary amine is selected from the group consisting of dibutylamine, diamylamine, dihexylamine, bis-2-ethylhexylamine, and diheptylamine; and wherein the tertiary amine is selected from the group consisting of tri-n-butylamine, tri-n-octylamine, tri-decylamine, tri-laurylamine, tri-hexadecylamine, and dimethyloleylamine.

18. The lubricating composition of claim 1, wherein the sulphur-free amine salt is derived from a tertiary-aliphatic primary amine.

19. The lubricating composition of claim 1 wherein the sulphur-free amine salt is derived from a primary amine or a secondary amine and wherein each R" contains 8 to about 26 carbon atoms.

* * * * *